US008492631B1

(12) United States Patent
Atkins

(10) Patent No.: US 8,492,631 B1
(45) Date of Patent: Jul. 23, 2013

(54) STRINGED INSTRUMENT PLECTRUM

(76) Inventor: Frank Atkins, Baltimore, MD (US)

( * ) Notice: Subject to any disclaimer, the term of this patent is extended or adjusted under 35 U.S.C. 154(b) by 0 days.

(21) Appl. No.: 13/470,492

(22) Filed: May 14, 2012

(51) Int. Cl.
*G10D 3/16* (2006.01)

(52) U.S. Cl.
USPC ..... 84/320

(58) Field of Classification Search
USPC ..... 84/320–322
See application file for complete search history.

(56) References Cited

U.S. PATENT DOCUMENTS 3,735,663 A 5/1973 Cowell, Sr.
4,982,641 A 1/1991 Duhart
D448,400 S * 9/2001 Freeman ..... D17/20
7,067,729 B2 * 6/2006 Leong ..... 84/322
2008/0163737 A1 7/2008 Grant
2010/0263515 A1 10/2010 Hollin, Jr.

* cited by examiner

*Primary Examiner* — Kimberly Lockett

(57) ABSTRACT

A stringed instrument plectrum that includes a second edge disposed perpendicularly with respect to a first edge, a rounded top portion disposed endwise opposite the first edge, a protruding pick portion disposed over a third edge, and a plurality of indentations disposed along the third edge, whereby said stringed instrument plectrum is more easily grasped within the hand of a musician, while yet enabling dexterous manipulation of a striking edge disposed upon a tip of the protruding pick portion, for rendering melody upon the relevant strings of a stringed instrument to which the present stringed instrument plectrum is applied when making music.

6 Claims, 4 Drawing Sheets

STRINGED INSTRUMENT PLECTRUM

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of stringed instrument plectrums are known in the prior art. However, what is needed is a stringed instrument plectrum that includes a second edge disposed perpendicularly with respect to a first edge, a rounded top portion disposed endwise opposite the first edge, a protruding pick portion disposed over a third edge, and a plurality of indentations disposed along the third edge, whereby said stringed instrument plectrum is more easily grasped within the hand of a musician, while yet enabling dexterous manipulation of a striking edge disposed upon a tip of the protruding pick portion, for rendering melody upon the relevant strings of a stringed instrument to which the present stringed instrument plectrum is applied when making music.

FIELD OF THE INVENTION

The present invention relates to a stringed instrument plectrum, and more particularly, to a stringed instrument plectrum that includes a second edge disposed perpendicularly with respect to a first edge, a rounded top portion disposed endwise opposite the first edge, a protruding pick portion disposed over a third edge, and a plurality of indentations disposed along the third edge, whereby said stringed instrument plectrum is more easily grasped within the hand of a musician, while yet enabling dexterous manipulation of a striking edge disposed upon a tip of the protruding pick portion for rendering melody upon the relevant strings of a stringed instrument to which the present stringed instrument plectrum is applied when making music.

SUMMARY OF THE INVENTION

The general purpose of the stringed instrument plectrum, described subsequently in greater detail, is to provide a stringed instrument plectrum which has many novel features that result in a stringed instrument plectrum which is not anticipated, rendered obvious, suggested, or even implied by prior art, either alone or in combination thereof.

The present stringed instrument plectrum is considered for use with an extant stringed instrument such as a guitar, mandolin, or bass, among other examples, and has been devised to enable a player to more easily and securely hold said stringed instrument plectrum while maintaining dexterous and manipulative control of a striking edge of the present stringed instrument plectrum to create melody upon the relevant strings of the stringed instrument to which the present stringed instrument plectrum is applied.

When learning to play a stringed instrument such as a guitar, for example, holding the plectrum or pick can be challenging. Many a guitar player, for example, knows the frustration of dropping a pick inside an acoustic guitar sound hole and then having, by some curious feat of repositioning, shaking, and inversion, scrabble the pick out again.

The present stringed instrument plectrum, therefore, has been devised to enable a musician to more easily hold a pick. While the present stringed instrument plectrum is envisioned for use by students learning to play a stringed instrument, such as a guitar, with which use of a plectrum is common, the present stringed instrument plectrum should not be considered limited for use with guitars or by students alone. The present invention may be produced at different scales appropriate for use with other stringed instruments. For example, a smaller stringed instrument plectrum is producible for use with a mandolin. However, it should be noted that the general proportions of the instant stringed instrument plectrum herein disclosed will be maintained.

Most plectrums or picks for use with stringed instruments are small, flat bodies, generally lanceolate in shape, devised to be grasped between the thumb and forefingers of a musician's hand. Practice is required to master their use. The present invention comprises a larger body configured to ergonomically fit a hand, extending from out the palm. The present stringed instrument plectrum therefore enables more secure placement in the hand, and increases the haptic connection between the player and the stringed instrument plectrum.

The present stringed instrument plectrum includes a first edge disposed delimiting a bottom end. A second edge is disposed generally perpendicular to the first edge. A rounded top portion is disposed endwise opposite the first edge delimiting a top end, and a diagonal edge leads from the top portion to a striking edge disposed at a tip disposed upon a protruding pick portion. A second diagonal edge runs from the striking edge to a third edge, the third edge disposed between the pick portion and the first edge. The third edge is disposed generally parallel with the second edge, and a plurality of indentations is disposed along the third edge, each of the plurality of indentations configured to ergonomically accommodate a finger thereat.

Thusly, the second edge is held flush to a palm of a musician wielding said stringed instrument plectrum, the rounded top portion is disposed proximal an index finger of the musician, and the pick portion is thereby disposed between the thumb and forefingers of the musician. The striking edge, disposed upon the tip of the pick portion is thereby used to render melody in striking the relevant strings of the stringed instrument to which the stringed instrument plectrum is applied.

The stringed instrument plectrum includes a first surface and a second surface. A plurality of chord diagrams is disposed upon each of the first surface and the second surface, each of said plurality of chord diagrams a graphic representation of a chord manually configured upon the neck of the relevant stringed instrument. Each of the plurality of chord diagrams is rendered in the familiar tablature format common in the present day. Thusly, the present stringed instrument plectrum is useable as a ready reference of a particular finger configuration for rendering a particular chord for a musician learning to play said stringed instrument.

For portability, a hole is disposed in the stringed instrument plectrum proximal to the first edge. The hole is configured to receive an extant lanyard, string, or key ring therethrough, by which hole the present stringed instrument plectrum is readily portable about the person of a musician.

An alternate embodiment is considered with a first pick portion disposed as in the previously disclosed embodiment, but with a second pick portion disposed upon the second edge enantiomorphically with respect to the first pick portion. A plurality of indentations, each of which indentations are likewise configured to ergonomically accommodate a finger thereat, is also disposed on the second edge. The alternate embodiment therefore has a vertical line of symmetry between the second edge and the third edge, and the alternate embodiment is therefore useable with either the first pick portion or the second pick portion disposed to strike the strings of a relevant stringed instrument when the alternate embodiment of the stringed instrument plectrum is grasped and wielded by a musician.

For increased comfort in using the present stringed instrument plectrum, the stringed instrument plectrum is configured with rounded corners to ergonomically conform to manual usage within the hand of a musician.

Thusly, the present stringed instrument plectrum ergonomically conforms to the hand of a musician, increases the haptic connection with the player, and enables dexterous manipulation for the rendering of melody upon the relevant strings of a stringed instrument to which it is applied. The present stringed instrument plectrum is more easily grasped and maintained in the hand when used to render such melody, and the present stringed instrument plectrum is less likely to fall into the sound hole of, for example, an acoustic guitar, when dropped accidentally.

Thus has been broadly outlined the more important features of the present stringed instrument plectrum so that the detailed description thereof that follows may be better understood and in order that the present contribution to the art may be better appreciated.

Objects of the present stringed instrument plectrum, along with various novel features that characterize the invention are particularly pointed out in the claims forming a part of this disclosure. For better understanding of the stringed instrument plectrum, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
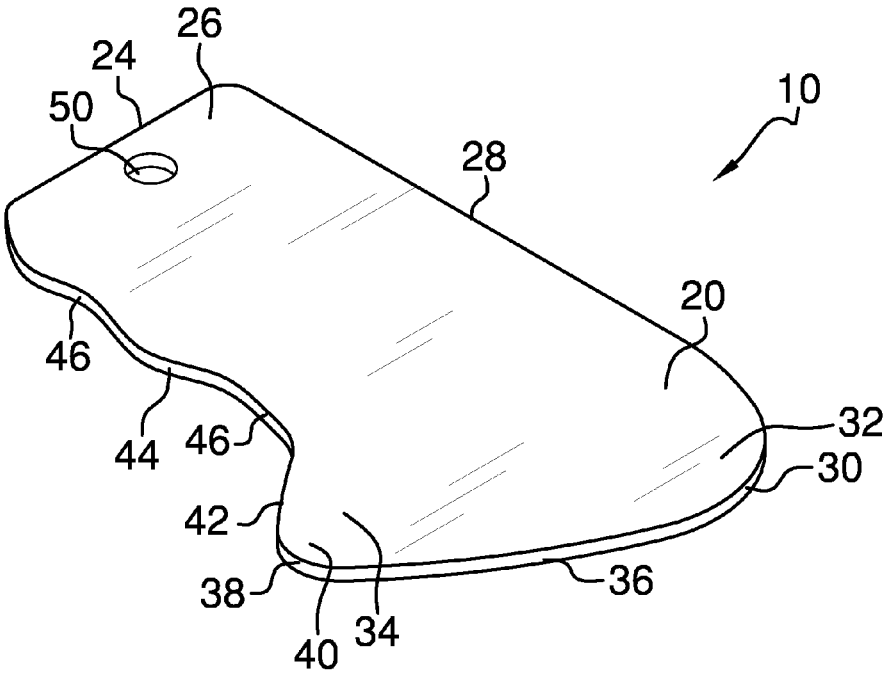
FIG. 1 is an isometric view.
Figure 2:
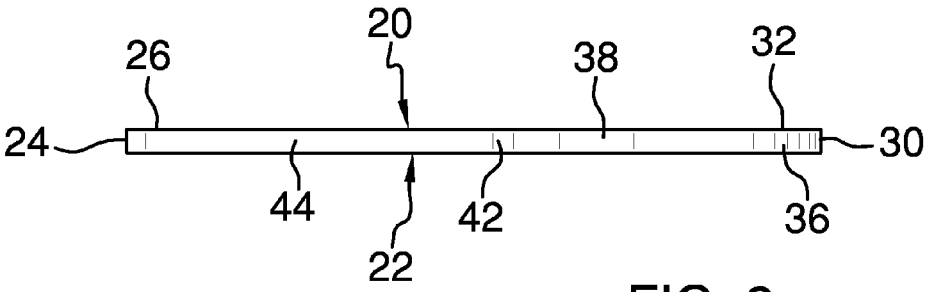
FIG. 2 is a side view.
Figure 3:
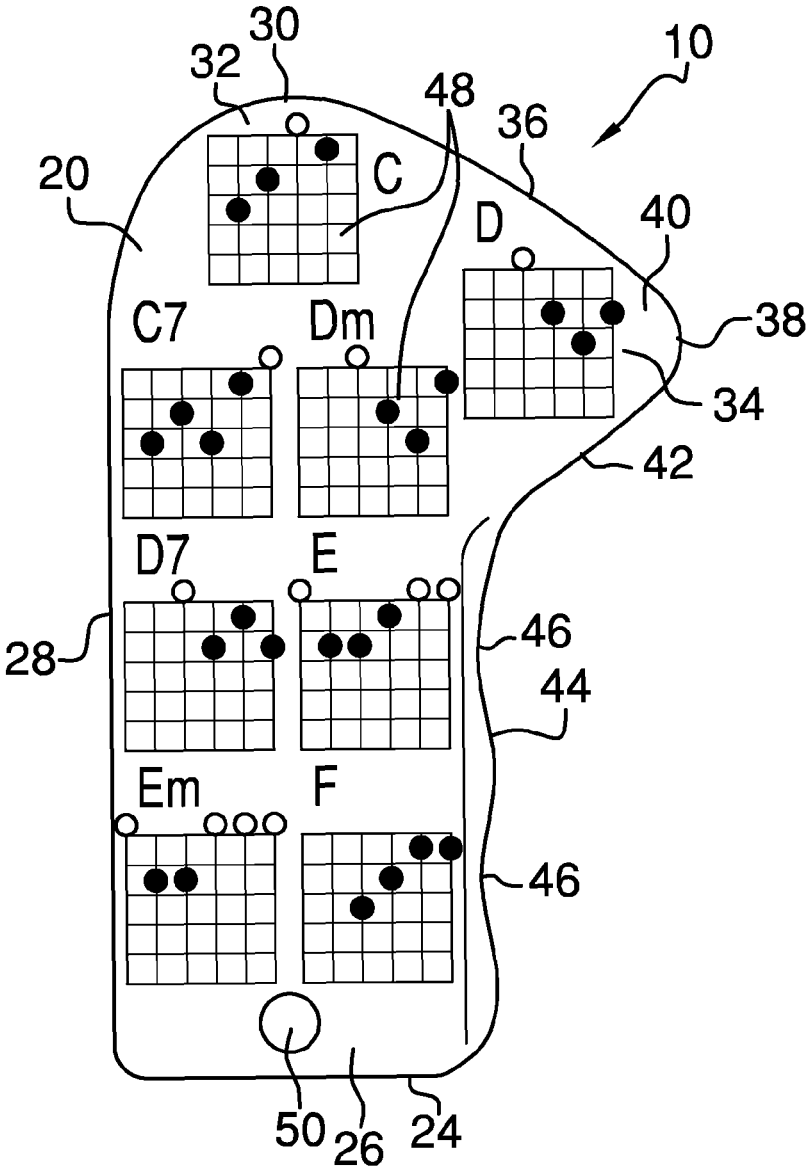
FIG. 3 is a view of a first surface.
Figure 4:
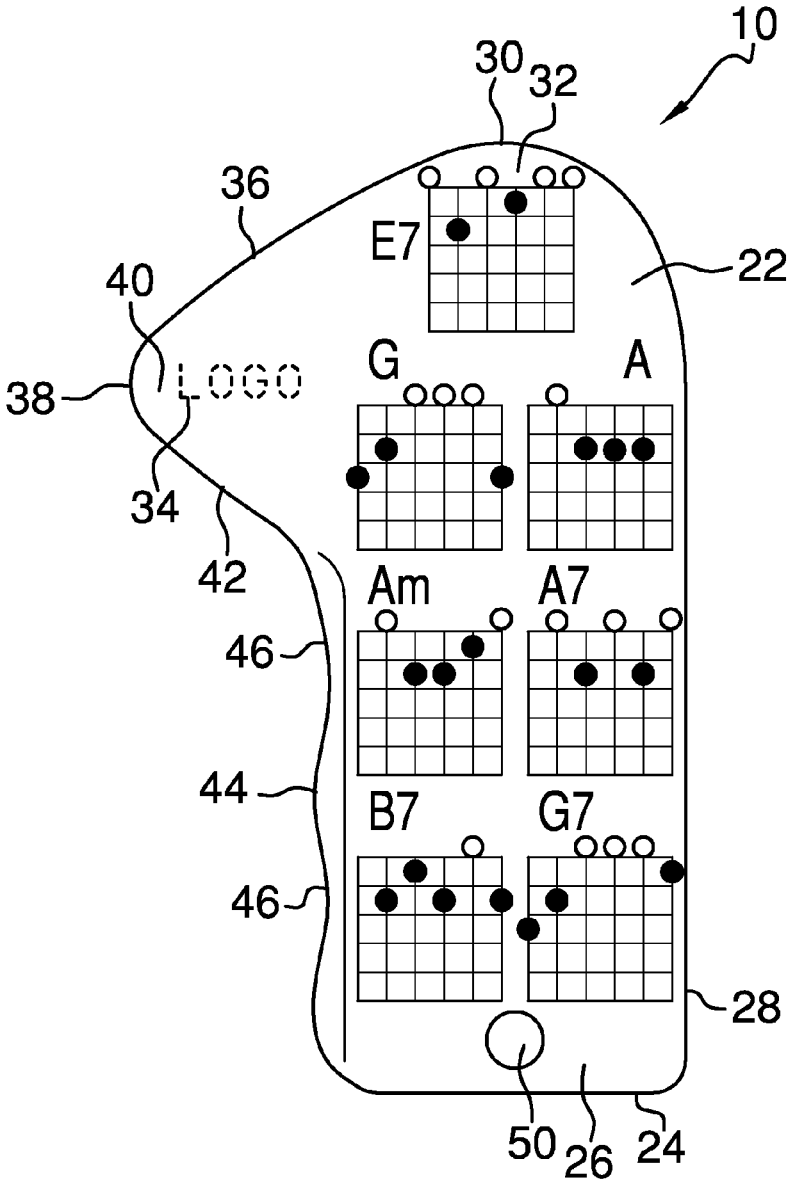
FIG. 4 is a view or a second surface.

With reference now to the drawings, and in particular FIGS. 1 through 5 thereof, example of the instant stringed instrument plectrum employing the principles and concepts of the present stringed instrument plectrum and generally designated by the reference number 10 will be described.

Referring to FIGS. 1 through 5 a preferred embodiment of the present stringed instrument plectrum 10 is illustrated.

The present stringed instrument plectrum 10 is considered for use with an extant stringed instrument, such as a guitar, bass, or mandolin. The present device 10 should not be considered limited to any one particular species of stringed instrument, the general form of the device 10 is appropriate across species of stringed instruments, as desired, and the scale of the present stringed instrument plectrum 10 should be considered sizeable to accommodate stringed instruments of differing sizes. For example, a stringed instrument plectrum 10 as disclosed herein, but useable with a mandolin, say, would be smaller in overall appearance. But the general proportions between the relevant components and elements of the present stringed instrument plectrum 10 will be maintained.

The purpose of the present stringed instrument plectrum 10 is to enable easier purchase to said plectrum 10 when playing, and learning to play, a stringed instrument such as a guitar. Picks and plectrums seen in the prior art are often small and configured to be grasped between the thumb and forefinger and middle finger. When learning to play with a plectrum, it is often hard to maintain ready purchase to such a pick or plectrum. The present device 10, therefore, enables a person to hold said stringed instrument plectrum 10 more comfortably within the palm of the hand, while still enabling dexterous manipulation of a pick portion 34 for manually striking appropriate strings when rendering musical melody.

The stringed instrument plectrum 10 includes a first surface 20 and a second surface 22. A first edge 24 is disposed at a bottom end 26 of the stringed instrument plectrum 10. A second edge 28 is disposed right-angularly with respect to the first edge 24, the second edge 28 having a length at least twice the length of the first edge 24. A rounded top portion 30 is disposed on a top end 32 of the stringed instrument plectrum 10. A protruding pick portion 34 is disposed frontward from the rounded top portion 30. A diagonal edge 36 leads from the rounded top portion 30 to a striking edge 38 disposed at a tip 40 of the pick portion 34. A second diagonal edge 42 leads from the tip 40 of the pick portion 34 to conjoin with a third edge 44.

The third edge 44 is disposed between the pick portion 34 and the first edge 24. The third edge 44 is generally perpendicular with respect to the first edge 24. A plurality of indentations 46 is disposed along the third edge 44, each of said plurality of indentations 46 configured to ergonomically receive a finger thereat.

The stringed instrument plectrum 10 is configured to ergonomically conform to a palm of a hand of a person holding said plectrum 10 whereby the pick portion 34 protrudes therefrom for striking the strings of an extant stringed instrument. The present stringed instrument plectrum 10 is therefore more easily grasped when playing a stringed instrument, such as a guitar.

The present stringed instrument plectrum 10 is considered with a plurality of chord diagrams 48 in tablature format depicted upon each of the first surface 20 and the second surface 22. Each of the plurality of chord diagrams 48 represents a specific chord applicable to the stringed instrument for which the present stringed instrument plectrum 10 is devised. In the preferred embodiment herein illustrated, said stringed instrument is considered as a guitar—however other stringed instruments are considered for use with the device 10, such as a mandolin, for example. The device 10 may be produced at various scales, with the proportions of the instant stringed instrument plectrum 10 maintained throughout said scales, and the device 10 should not be considered limited for use with guitars only.

Figure 5:
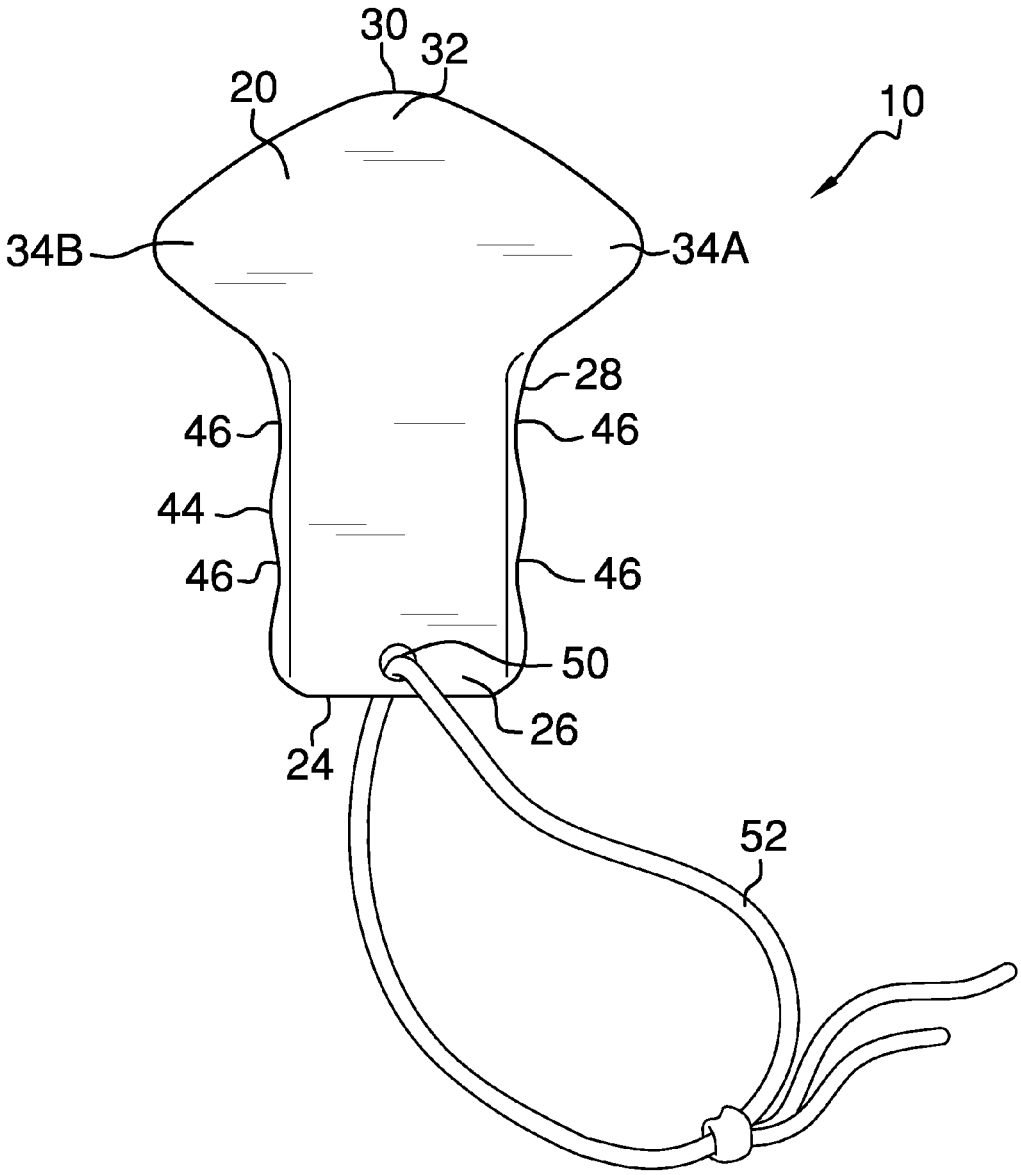
FIG. 5 is a view of an alternate embodiment.

An alternate embodiment is shown in FIG. 5, wherein the stringed instrument plectrum 10 has a first pick portion 34*a* and a second pick portion 34*b* disposed enantiomorphically from the rounded top portion 30 such that the stringed instrument plectrum 10 is useable with either the first pick portion 34*a* or the second pick portion 34*b* disposed to strike the strings of the instrument to which the stringed instrument plectrum 10 is applied. A plurality of indentations 46 is disposed upon each of the second edge 28 and the third edge 44 to ergonomically fit the device 10 to a hand of a person wielding said device 10. In this alternative embodiment, the stringed instrument plectrum 10 has a longitudinal line of symmetry and said stringed instrument plectrum 10 is reversibly positional within a hand of a person wielding said stringed instrument plectrum 10 around said line of symmetry.

The present stringed instrument plectrum 10 has a hole 50 disposed proximal to the first edge 24, said hole 50 configured to releasably receive an extant lanyard 52, string, or key ring, therethrough, whereby the present stringed instrument plectrum 10 may be suspended therefrom for convenient and accessible carriage, as desired (see FIG. 5).

The preferred embodiment illustrated herein is considered for use with guitars, and the first edge 24 is approximately 3.2 cm (1.25 inches) long, the second edge 28 is approximately 8.9 cm (3.5 inches) long, and the length from the second edge 28 to the striking edge 38 of the protruding pick portion 34 tip 40 is approximately 5.1 cm (2 inches). When said stringed instrument plectrum 10 is sized appropriate to another stringed instrument, such as a mandolin or bass, for example, the dimensions may be resized appropriate to said instrument, but the general proportions of the stringed instrument plectrum 10 will remain.

What is claimed is:

1. A stringed instrument plectrum comprising:
a first surface and a second surface;
a first edge;
a second edge disposed right-angularly with respect to the first edge;
a rounded top portion;
a protruding pick portion disposed frontward from the rounded top portion;
a third edge disposed between the pick portion and the first edge, the third edge generally perpendicular with respect to the first edge;
a plurality of indentations disposed along the third edge, each of said plurality of indentations configured to ergonomically receive a finger thereat;
wherein the stringed instrument plectrum is configured to ergonomically conform to a palm of a hand of a person holding said plectrum whereby the pick portion protrudes therefrom for striking the strings of an extant stringed instrument.

2. The stringed instrument plectrum of claim 1 further comprising a hole proximal the first edge, said hole configured to releasably receive an extant lanyard therethrough.

3. The stringed instrument plectrum of claim 2 further comprising a plurality of chord diagrams disposed across the first surface and the second surface, each of said chord diagrams illustrating a musical chord in tablature form relevant to a particular stringed instrument.

4. A stringed instrument plectrum comprising:
a first surface and a second surface;
a first edge;
a rounded top portion;
a protruding first pick portion disposed frontward from the rounded top portion;
a protruding second pick portion disposed rearward from the rounded top portion;
a second edge disposed between the second pick portion and the first edge, the second edge generally perpendicular with respect to the first edge;
a third edge disposed between the first pick portion and the first edge, the third edge generally perpendicular with respect to the first edge;
a plurality of indentations disposed along each of the second edge and the third edge, each of said plurality of indentations configured to ergonomically receive a finger therein;
wherein the stringed instrument plectrum is configured to ergonomically conform to a palm of a hand of a person holding said plectrum, whereby the first and alternately the second pick portion protrudes therefrom for striking the strings of an extant stringed instrument.

5. The stringed instrument plectrum of claim 4 further comprising a hole proximal the first edge, said hole configured to releasably receive an extant lanyard therethrough.

6. The stringed instrument plectrum of claim 5 further comprising a plurality of chord diagrams disposed across the first surface and the second surface, each of said chord diagrams illustrating a musical chord in tablature form appropriate for a particular stringed instrument.

* * * * *